United States Patent [19]

Strebel

[11] Patent Number: 4,954,035

[45] Date of Patent: Sep. 4, 1990

[54] VEHICLE PARK FOR PARKING VEHICLES BELOW A WATER SURFACE

[76] Inventor: Hannes Strebel, Luppmen, Hittnau, Switzerland

[21] Appl. No.: 261,506

[22] Filed: Oct. 24, 1988

[30] Foreign Application Priority Data

Oct. 26, 1987 [CH] Switzerland ..... 4175/87

[51] Int. Cl.[5] ..... E04H 6/00

[52] U.S. Cl. ..... 414/228; 414/233; 52/169.6; 405/205; 405/210; 114/257

[58] Field of Search ..... 414/227, 228, 232, 233, 414/264; 52/169.6, 169.14, 174, 175, 176; 114/257, 313, 314, 321, 270; 405/195, 203, 205, 210

[56] References Cited

U.S. PATENT DOCUMENTS

| | | | |
|---|---|---|---|
| 1,682,679 | 8/1928 | Lawton | 52/175 |
| 3,477,234 | 11/1969 | Aquino | 405/195 |
| 3,855,809 | 12/1974 | Westling | 114/257 X |

FOREIGN PATENT DOCUMENTS

| | | | |
|---|---|---|---|
| 0313761 | 5/1989 | European Pat. Off. . | |
| 2232854 | 1/1974 | Fed. Rep. of Germany | 414/228 |
| 2024701 | 12/1974 | Fed. Rep. of Germany | 414/227 |
| 3605998 | 8/1987 | Fed. Rep. of Germany | 52/175 |
| 2180578 | 4/1987 | United Kingdom | 52/169.6 |
| 2211877 | 7/1987 | United Kingdom | 52/169.6 |

*Primary Examiner*—Joseph J. Rolla
*Assistant Examiner*—Born Miler
*Attorney, Agent, or Firm*—Helfgott & Karas

[57] ABSTRACT

A parking garage is constructed substantially as a ship hull and includes a container which is preferably made of steel or reinforced concrete parts and is subdivided into three parking levels. The container can be sunk below the water surface of a lake or river at the intended location. At the corresponding predetermined depth the garage can be leveled by raising and lowering devices arranged on the longitudinal sides of the container and which substantially bore into the bed as a result of their own weight and additional weights placed on the top of the container. In the operating state the raising and lowering devices are controlled by sensors and activated, so that even in the case of positional changes, e.g. due to different loads, an exact leveling of the parking garage is ensured. The garage is provided with two, longitudinally spaced tubular tunnels, flanged to the longitudinal side of the container and connected to the lake or river bank.

12 Claims, 4 Drawing Sheets

VEHICLE PARK FOR PARKING VEHICLES BELOW A WATER SURFACE

BACKGROUND OF THE INVENTION

The invention relates to a garage or park for parking vehicles below a water surface, particularly below the water surface of a lake.

It is known to install a car park building or multistory car park garage in a river bed dried for building work and then, at the end of the building period, to allow the river to run freely again.

The problem of providing parking, particularly in conurbations is generally known. The solution of the problem by means of conventional multistory or underground car parking garages often fails due to the problem of preparing the building site and to the complicated procedure involved in obtaining building authorization, together with the relatively high building costs.

SUMMARY OF THE INVENTION

It is an object of the present invention to provide an improved garage for parking vehicles in order to solve the parking problem in the case of cities bordering a lake or corresponding river.

This and other objects of the invention are attained by a vehicle park which includes a large container, which is constructed in a ship hull-like manner and can be placed beneath the surface of the water and which is provided with at least one parking level. A tubular tunnel connected to the lake or river bank for carrying vehicles and persons is connected, for example, by flanging to the container.

The aforementioned objects, features and advantages of the invention will, in part, become obvious from the following more detailed description of the invention, taken in conjunction with the accompanying drawing, which form an integral part thereof.

DETAILED DESCRIPTION OF THE PREFERRED EMBODIMENTS

Figure 1:
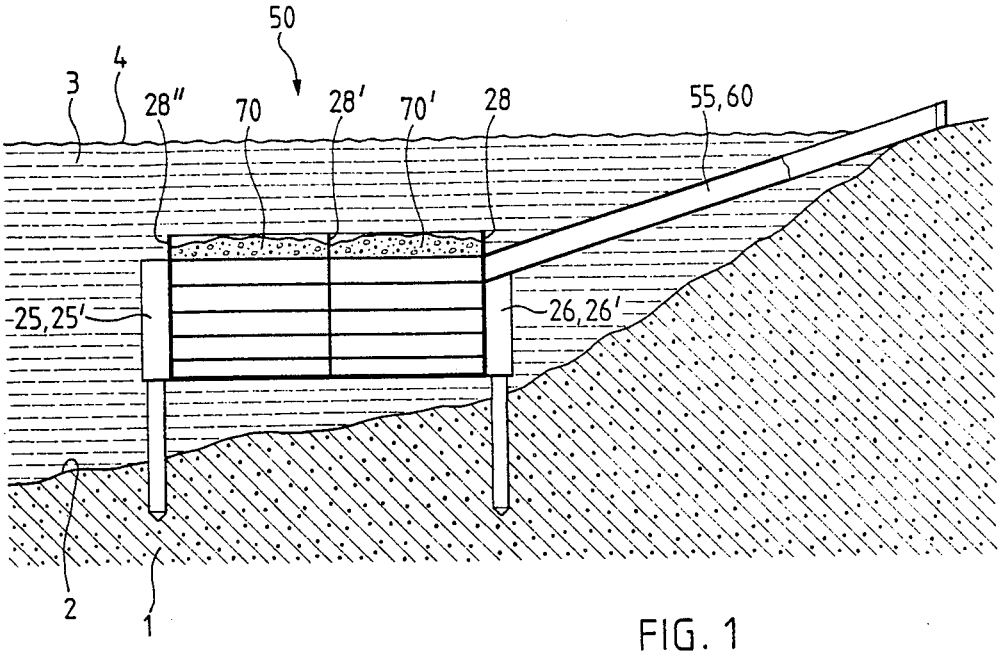
FIG. 1 is a diagrammatic side view of a garage for parking vehicles below a water surface, according to the invention.

To illustrate the invention in the form of a general survey view, FIG. 1 is a side view of a vehicle park or garage 50 for parking vehicles, preferably cars, below a water surface. It is possible to see in FIG. 1 in profile cross-section a topographical structure of a bank, e.g. a lake bank. In this topographical structure, 1 is essentially a natural lake bed, 2 is the surface of the bed, 3 is the water and 4 is the water level surface. The mobile parking garage 50 is stationed at the intended location, preferably in the vicinity of a point on the bank topographically corresponding to entrance and exit 55, 60 to and from the parking garage and, at a corresponding depth with respect to the water surface, the garage 50 is locally fixed by appropriate fixing means 25, 25' and 26, 26', e.g. is installed in a floating manner. For stabilizing the parking garage 50, local position weights 70, 70' are arranged at the top of the parking garage 50. These weights are arranged in correspondingly provided and preferably longitudinally and transversely subdivided basins or tanks. The weights can be constituted by reinforced concrete parts, rubble stone, etc. Individual tanks 29', 30', 31', 32'and 33', only some of which are shown in FIG. 2 and which are provided for the individual weights (not shown in FIG. 2) are longitudinally limited by webs 28, 28', 28'' (FIG. 1) and transversely limited by webs 29, 30, 31, 32, 33 and 34 (FIG. 2).

Figure 2:
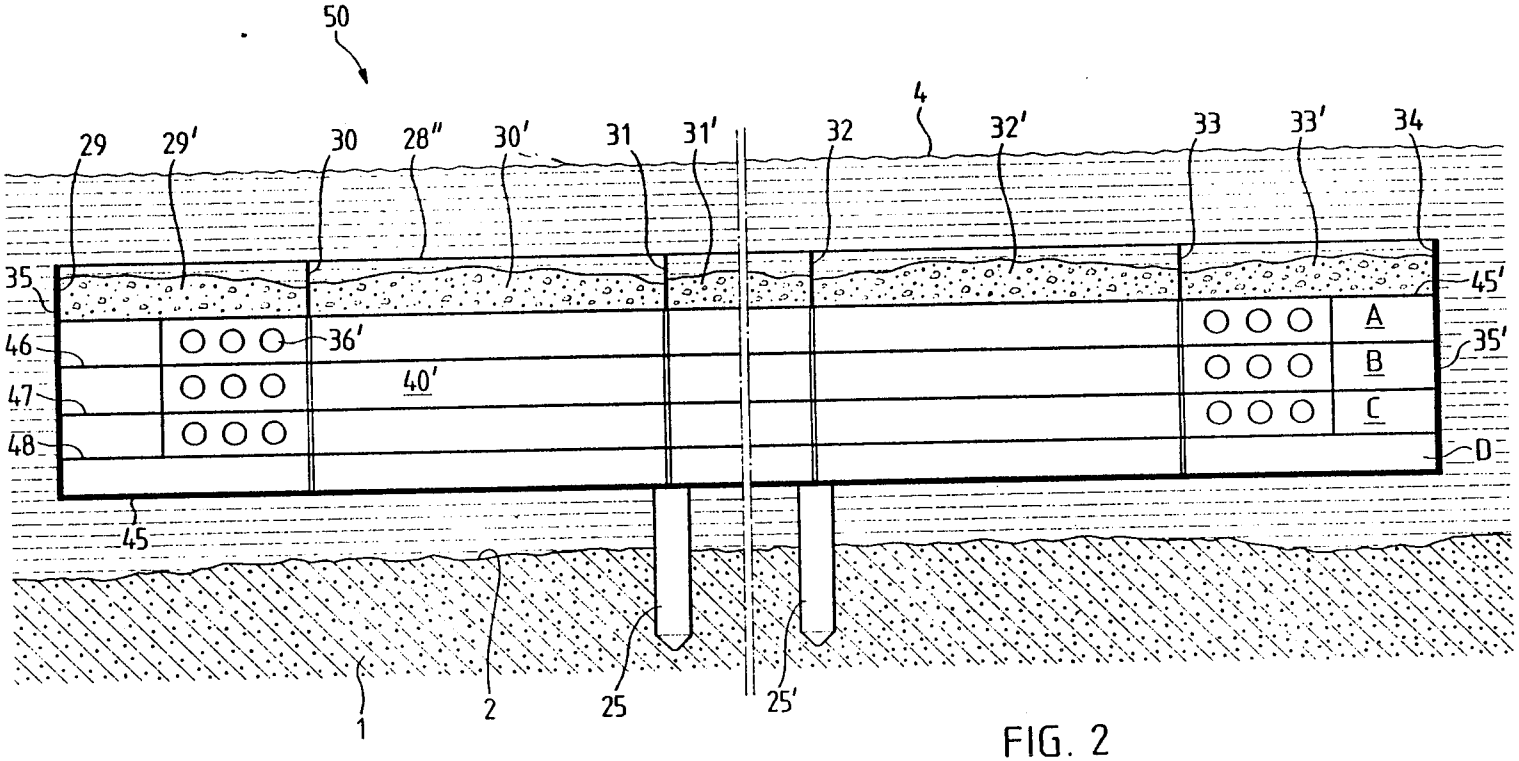
FIG. 2 is a sectional view of the garage according to FIG. 1 on a larger scale.
Figure 3:
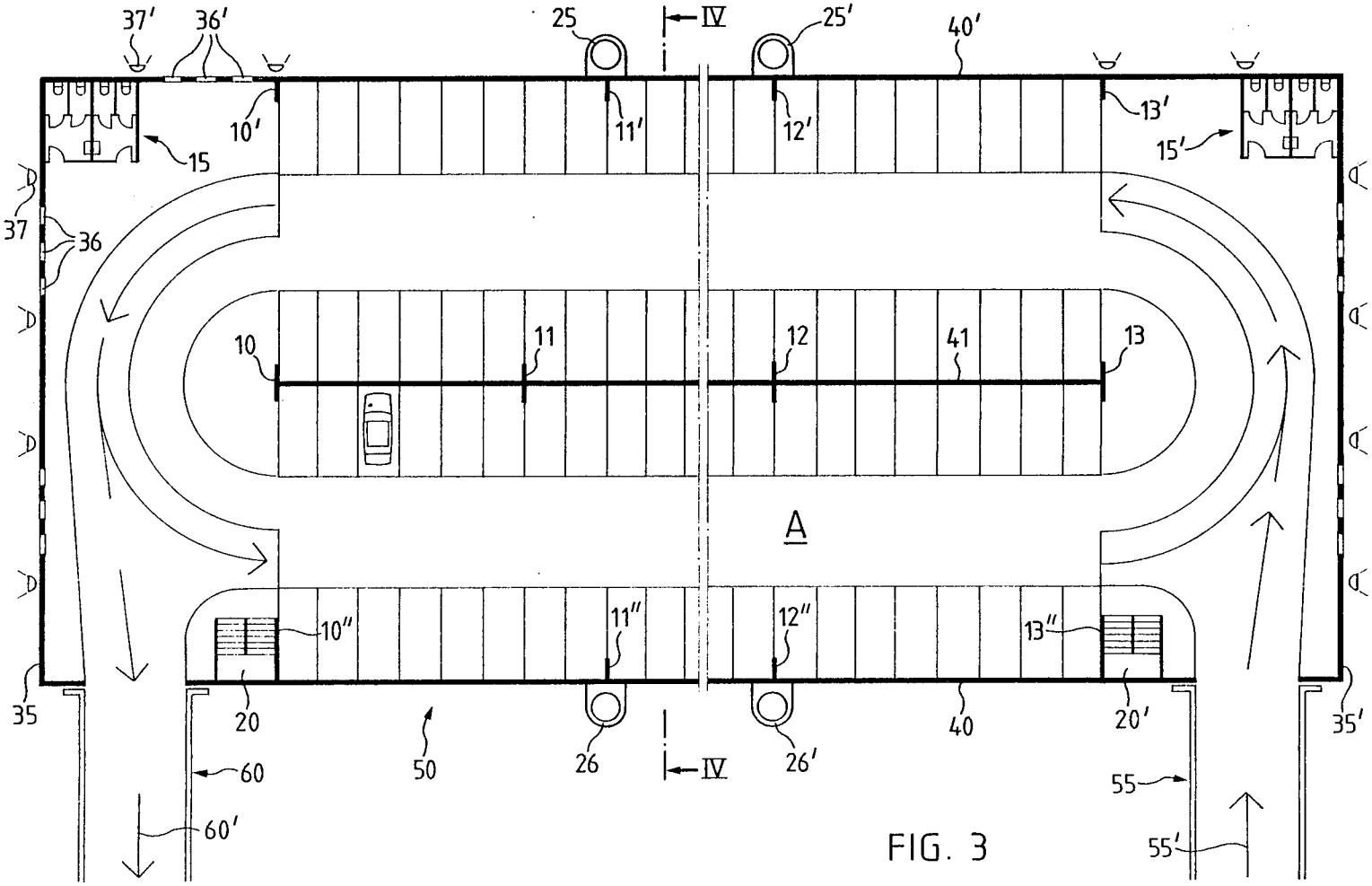
FIG. 3 is a top plan view of a section of the garage according to FIGS. 1 and 2.

As best seen in FIGS. 2 and 3, the parking garage 50, shown there on a larger scale, is comprised of e.g. a hull or large container, which comprises a floor or bottom 45, two longitudinally oriented, vertical outer or side walls 40, 40' and two substantially transversely oriented, vertical end walls 35, 35'. On the side facing the water surface 4, the parking garage 50 is closed by a cover 45' arranged roughly parallel to bottom 45 and extending over the entire length and width of the garage. The substantially hull-like parking garage 50 has a non-shown cavity or hollow space formed by the outer walls 40, 40' and 35, 35', the bottom 45 and the cover or top 45' and which, as shown in FIG. 2, is subdivided by means of intermediate floors or bottom walls 46, 47, 48 into so-called parking levels, there being three such levels A, B and C in the exemplified embodiment. Between the lower floor 45 and the intermediate floor 48, a further cavity D is provided for assisting the buoyancy of the overall parking garage 50.

FIG. 3 shows the parking garage 50 in a plan sectional view with the parking level A, e.g. subdivided into a plurality of not shown parking spaces and it is possible to see the side walls 40, 40', the front and rear walls 35, 35' and a longitudinally oriented partition 41. The partition 41 arranged on either side and spaced from the two walls 35, 35' can be constructed by a number of not shown, individual elements between the individual floors 45', 46, 47, 48 and bottom 45 or, as diagrammatically shown in FIG. 4, as a continuous partition 41 extending from the floor 45 to the top 45'. On the inner sides of side walls 40, 40' and on the two sides of the partition 41, are provided spaced reinforcing elements 10, 10', 10''; 11, 11', 11'', 12, 12', 12'' and 13, 13', 13'' (FIG. 3). Externally on the longitudinally oriented side walls 40, 40', are provided at least two, correspondingly spaced, column-like raising and lowering means 25, 25' and 26, 26', by means of which the complete parking garage 50 can be leveled during installation in accordance with the local, topographical conditions and also in operation in the case of any position changes caused by different loading. The raising and lowering means 25, 25' and 26, 26' are preferably individually controlled and operated by not shown conventional sensors operatively connected with the raising and lowering means for the leveling of the parking garage 50.

FIG. 3 also shows at 20 and 20', an entrance and an exit staircase, respectively, for pedestrians, these staircases interlinking the individual parking levels A, B and C, as well as a tunnel 55 on the side wall 40 facing the bank for driving into the parking garage 50 in the direction of arrow 55' and a tunnel 60 spaced from tunnel 55 for the vehicles to drive out of the garage in the direction of arrow 60'.

Toilets 15, 15' are also provided on every parking level. According to another embodiment of the parking garage 50, it is possible to provide in the individual walls 35, 35' and/or 40, 40' spaced windows, preferably portholes 36, 36', such as known from the shipbuilding field, and with correspondingly associated underwater lighting equipment 37, 37'.

It is pointed out that for the sake of clarity, FIGS. 2 and 3 essentially show only two end regions of the parking garage 50 without the central part having roughly the same distribution. The parking garage 50 is, e.g. 120 m long, 30 m wide and 12.5 m high. The parking garage 50 subdivided into parking levels A, B and C and having the above dimensions has roughly 480 parking spaces. It is possible to drive in and out of the individual parking levels A, B and C, e.g. in the manner known from multistory car parks.

Figure 4:
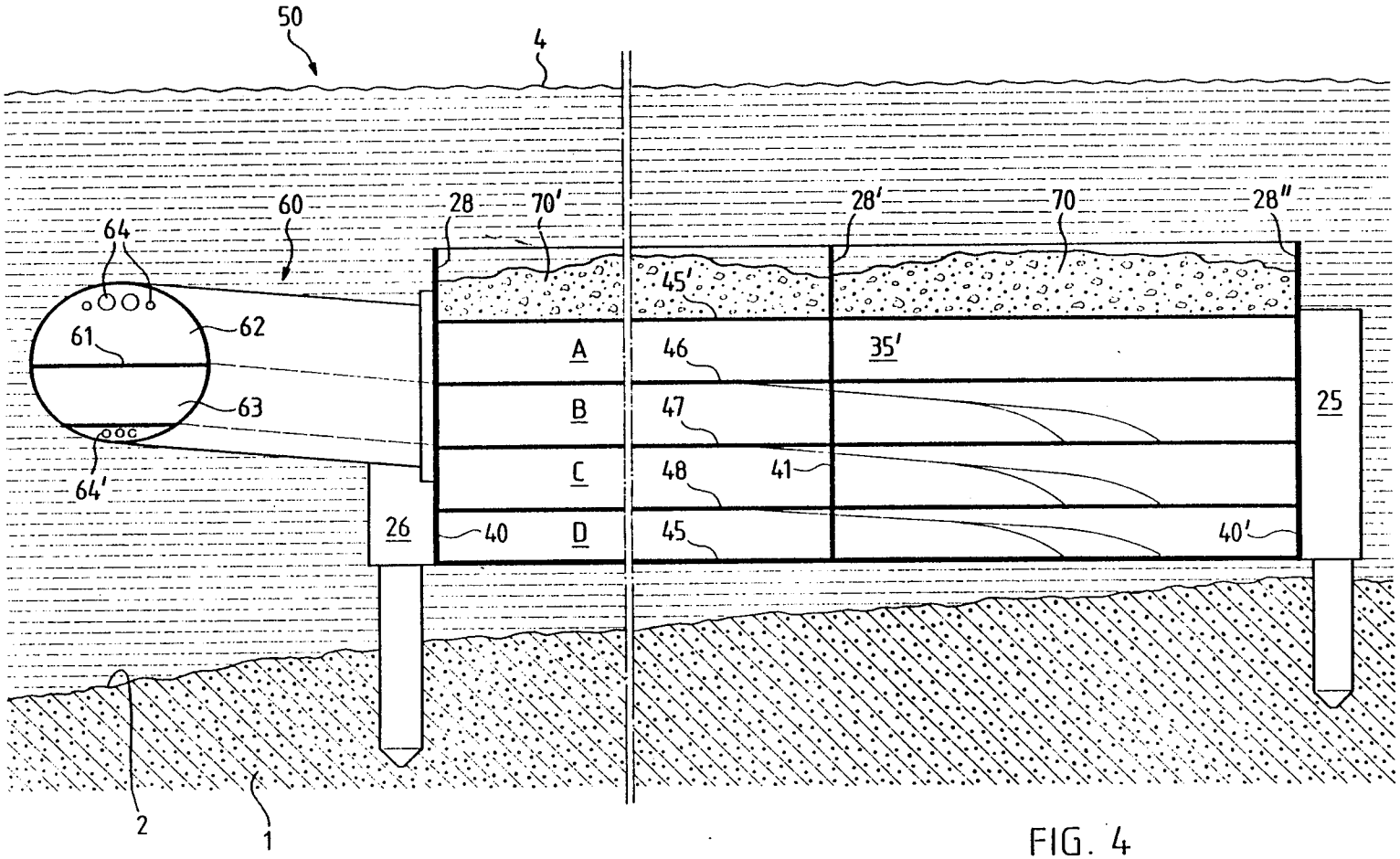
FIG. 4 is a section along line IV—IV of FIG. 3, on a larger scale.

FIG. 4 shows, on a larger scale and in section along line IV—IV taken in FIG. 3, the parking garage 50 in profile. The parking garage 50 is provided with laterally arranged support means 25*a* , 26*a* , the parking levels A, B and C separated by the individual floors 45, 46, 47, 48 with the gap D, and the tunnel 60 externally sealingly flanged to the side wall 40 by any suitable not shown means. Tunnel 60, which is shown in partly staggered form, is preferably constructed by cylindrical tubes and is subdivided by an intermediate floor 61 into a vehicle level 62 and a pedestrian level 63. FIG. 4 also shows pipes 64, 64' or the like arranged in the tunnel 60 and leading in not shown manner into the parking garage to provide necessary power and fresh air supply, as well as for removing exhaust gases and the like. The tunnel 55 which is not shown in FIG. 4 is constructed preferably identically to tunnel 60.

The above-described underwater parking garage 50 can e.g. be industrially manufactured from steel or reinforced concrete parts in the same way as a hull and is subsequently transported to its intended location and is preferably towed in a floating manner thereto. At the installation point the parking garage is flooded, so that as a result of its own weight and the weight of the water received therein it is sunk to a depth which is not prejudicial to shipping, e.g. to about 10 m below the water level. The raising and lowering means 25, 25' and 26, 26' correspondingly provided on the side facing the bed are respectively deeply drilled or pressed into the latter. The two tunnels 55 and 60 are then installed, followed by the fitting of the necessary weights 70, 70. The water is then pumped out, and finally the parking garage 50 is brought into the necessary horizontal position by means of the hydraulically actuated raising and lowering means 25, 25' and 26, 26'. The parking garage 50 is not bound to a particular location and if necessary can be installed at a different point on the bank. In a not shown variant, it is possible for supporting the raising and lowering means 25, 25' and 26, 26' carrying the parking garage 50 for installation to take place on correspondingly arranged foundations introduced into the lake bed. The foundations will remain in situ if there is a position change with respect to the parking garage 50.

There has been disclosed heretofore the best embodiment of the invention presently contemplated. However, it is to be understood that various changes and modifications may be made thereto without departing from the spirit of the invention.

What is claimed is:

1. Vehicle garage for parking vehicles below water surface of a lake, a river, or the like, comprising a large container constructed as a ship-hull and which can be stationed below the water surface, said container including at least one parking level, and at least one tubular tunnel arranged on said parking level and connected to a lake or river bank for a transit of vehicles and persons; and raising and lowering means for raising and lowering the garage with respect to said water surface to level the garage depending upon topographical conditions and loading-dependent changes thereof.

2. Vehicle garage according to claim 1, wherein said tubular tunnel is flanged at said at least one parking level.

3. Vehicle garage according to claim 1, wherein said raising and lowering means provided for positional changes of the garage are activated and controlled by sensors.

4. Vehicle garage according to claim 1, wherein the garage is mounted on corresponding foundations.

5. Vehicle garage according to claim 1, wherein said container has one longitudinal side roughly parallel to the bank and is connected to the bank by two tubular tunnels spaced from each other and flanged to a side wall of the longitudinal side of the container.

6. Vehicle garage according to claim 4, wherein said tunnels are each subdivided into a vehicle level and a pedestrian level by means of an intermediate floor for separate conveying of vehicles and persons into and out of the garage.

7. Vehicle garage according to claim 1, wherein said container is subdivided into three parking levels, which are interconnected by respective entrances and exits for vehicles and by corresponding staircases for pedestrians.

8. Vehicle garage according to claim 1, wherein said container is made of steel.

9. Vehicle garage according to claim 1, wherein said container is made of reinforced concrete parts.

10. Vehicle garage according to claim 1, wherein said at least one tubular tunnel is provided with respective pipes for power and fresh air supply and for removal of exhaust gases.

11. Vehicle garage according to claim 5, wherein each tubular tunnel is provided with respective pipes for power and fresh air supply and for removal of exhaust gases.

12. Vehicle garage according to claim 1, further comprising weights placed on a top of said container for stabilizing the garage in an operative position at the intended location.

* * * * *